US006238219B1

(12) United States Patent
Wu

(10) Patent No.: US 6,238,219 B1
(45) Date of Patent: May 29, 2001

(54) ELECTRICAL CONNECTION METHOD

(75) Inventor: Kun-Tsan Wu, Tu-Chen (TW)

(73) Assignee: Hon Hai Precision Ind. Co., Ltd., Taiepi Hsein (TW)

( * ) Notice: Subject to any disclaimer, the term of this patent is extended or adjusted under 35 U.S.C. 154(b) by 0 days.

(21) Appl. No.: 09/330,252

(22) Filed: Jun. 10, 1999

(30) Foreign Application Priority Data

Nov. 17, 1998 (TW) ..... 87118994

(51) Int. Cl.[7] ..... H01R 9/09
(52) U.S. Cl. ..... 439/74; 439/289
(58) Field of Search ..... 439/74, 289, 55, 439/65, 75

(56) References Cited

U.S. PATENT DOCUMENTS 5,055,054 * 10/1991 Doutrich ..... 439/66
5,306,163 * 4/1994 Asakawa ..... 439/74
5,697,799 * 12/1997 Consoli et al. ..... 439/181

* cited by examiner

*Primary Examiner*—Tulsidas Patel
*Assistant Examiner*—Thanh-Tam Le
(74) *Attorney, Agent, or Firm*—Wei Te Chung

(57) ABSTRACT

A method for electrically mating a plug connector with a socket connector includes the steps of (a) arranging plug contacts of the plug connector to extend along a first axis, each plug contact having a tip supported thereon by a deflectable portion and extending beyond the plug connector; (b) arranging socket contacts of the socket connector in passageways and extending along a second axis which is substantially normal to the first axis; (c) moving the plug and socket connectors toward each other to insert the tips of the plug contacts into the passageways and forming a point contact engagement with the socket contacts; (d) further moving the plug and socket connectors toward each other to cause deflection of the deflectable portions of the plug contacts with the tips sliding on the socket contacts; and (e) deflecting the deflectable portions of the plug contacts by further moving the plug and socket connectors toward each other to change the point contact between the plug contacts and the socket contacts to a surface contact therebetween.

5 Claims, 13 Drawing Sheets

ELECTRICAL CONNECTION METHOD

BACKGROUND OF THE INVENTION

1. Field of the Invention

The present invention generally relates to an electrical connection system comprising a socket connector and a plug connector mating together, and in particular to an electrical connection method for establishing electrical connection between socket and plug connectors wherein the contact engagement between contact elements thereof change from a point contact to a final surface contact.

2. The Prior Art

An electrical connection system comprises a plug connector and a socket connector mating with each other is well known in the electronics field. Connectors of this type are disclosed in Taiwan patent application Nos. 84213256 and 85201191.

The plug connector and the socket connector both have contacts engageable with each other. Conventionally, the contacts of the plug and socket connectors are engaged with each other in parallel. In other words, the contacts of the plug connector and the contacts of the socket connector are substantially parallel to each other during engagement. To ensure proper engagement between the plug contact and the socket contact, at least one of the contacts forms at least one bent section. Furthermore, the relative position between each socket contact and the corresponding plug contact has to be precise to ensure proper engagement therebetween. Such precise positioning of the contacts in the connectors increases the overall manufacturing cost and the likelihood of unstable electrical engagement.

It is thus desirable to have a method for connecting the plug and socket connectors, which does not require high contact positioning precision to obtain a proper and stable engagement therebetween.

SUMMARY OF THE INVENTION

Accordingly, an object of the present invention is to provide an electrical connection method for connecting socket and plug connectors and establishing a secure electrical engagement therebetween.

Another object of the present invention is to provide an electrical connection method for establishing proper electrical engagement between a plug connector and a socket connector which does not require the precise position of contacts.

To achieve the above objects, an electrical connection method for mating a plug connector with a socket connector in accordance with the present invention comprises the following steps: (1) arranging plug contacts of the plug connector to extend along a first axis, each plug contact having a tip supported thereon by a deflectable portion and extending beyond the plug connector; (2) arranging socket contacts of the socket connector in passageways and extending along a second axis which is substantially normal to the first axis; (3) moving the plug and socket connectors toward each other to insert the tips of the plug contacts into the passageways and forming a point contact engagement with the socket contacts; (4) further moving the plug and socket connectors toward each other to cause deflection of the deflectable portions of the plug contacts with the tips sliding on the socket contacts; and (5) deflecting the deflectable portions of the plug contacts by further moving the plug and socket connectors toward each other to change the point contact between the plug contacts and the socket contacts to a surface contact therebetween.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

An electrical connection system in accordance with the present invention comprises a plug connector and a socket connector mating with each other. Both the plug connector and the socket connector comprise conductive contact elements which are engageable with each other when mating the plug and socket connectors together thereby establishing electrical connection therebetween. In the electrical connection system of the present invention, the contact elements of the plug connector are brought into contact with the contact elements of the socket connector in a direction substantially normal thereto and the contact elements of the plug connector are deflected from a substantially normal condition with respect to the contact elements of the plug connector wherein a point contact is formed between each plug contact element and the corresponding socket contact element to a partially parallel condition wherein a surface contact is formed between the plug contact elements and the socket contact elements to ensure a firm contact engagement between.

Figure 1:
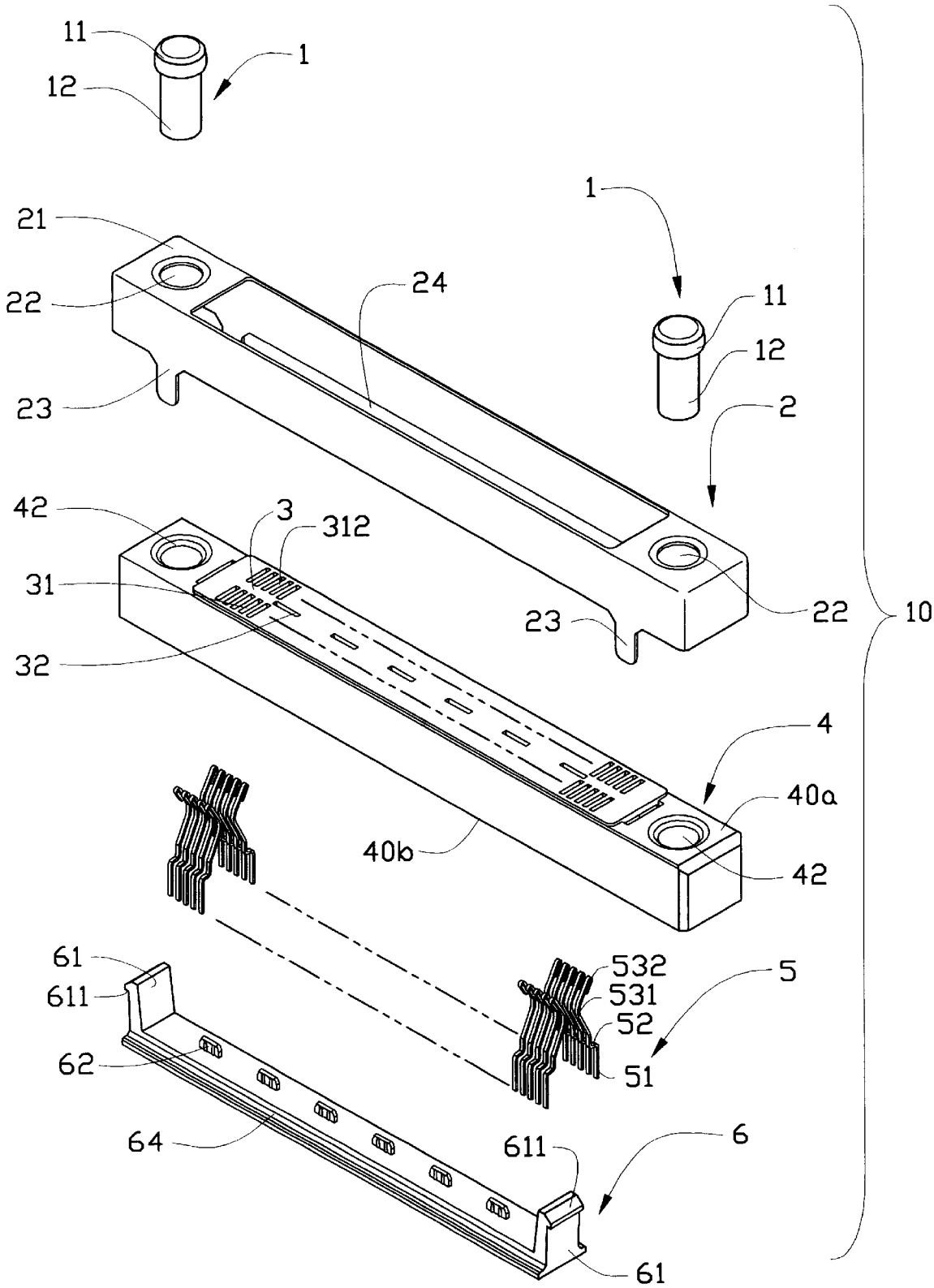
FIG. 1 is an exploded view of a plug connector of an electrical connection system in accordance with a first embodiment of the present invention.
Figure 2:
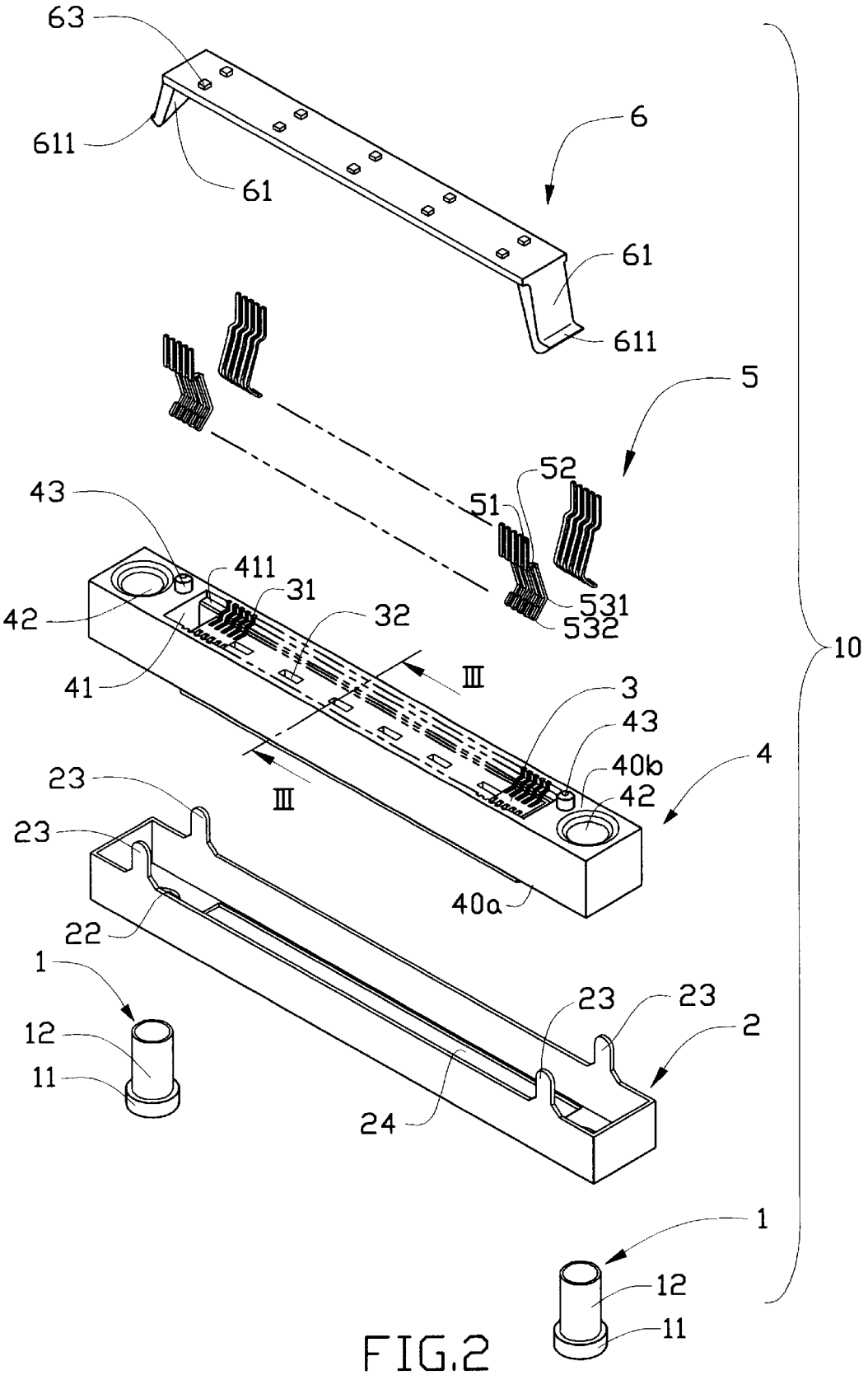
FIG. 2 is similar to FIG. 1 but taken from a different perspective.

Referring now to the drawings and in particular to FIGS. 1 and 2, a plug connector in accordance with the present invention, generally designated by reference numeral 10, comprises an elongate insulative housing 4 having a mating face 40*a* and a mounting face 40*b* opposite the mating face 40*a*. The mounting face 40*b* defines a cavity 41 therein into which an insert 6 is inserted.

Figure 3:
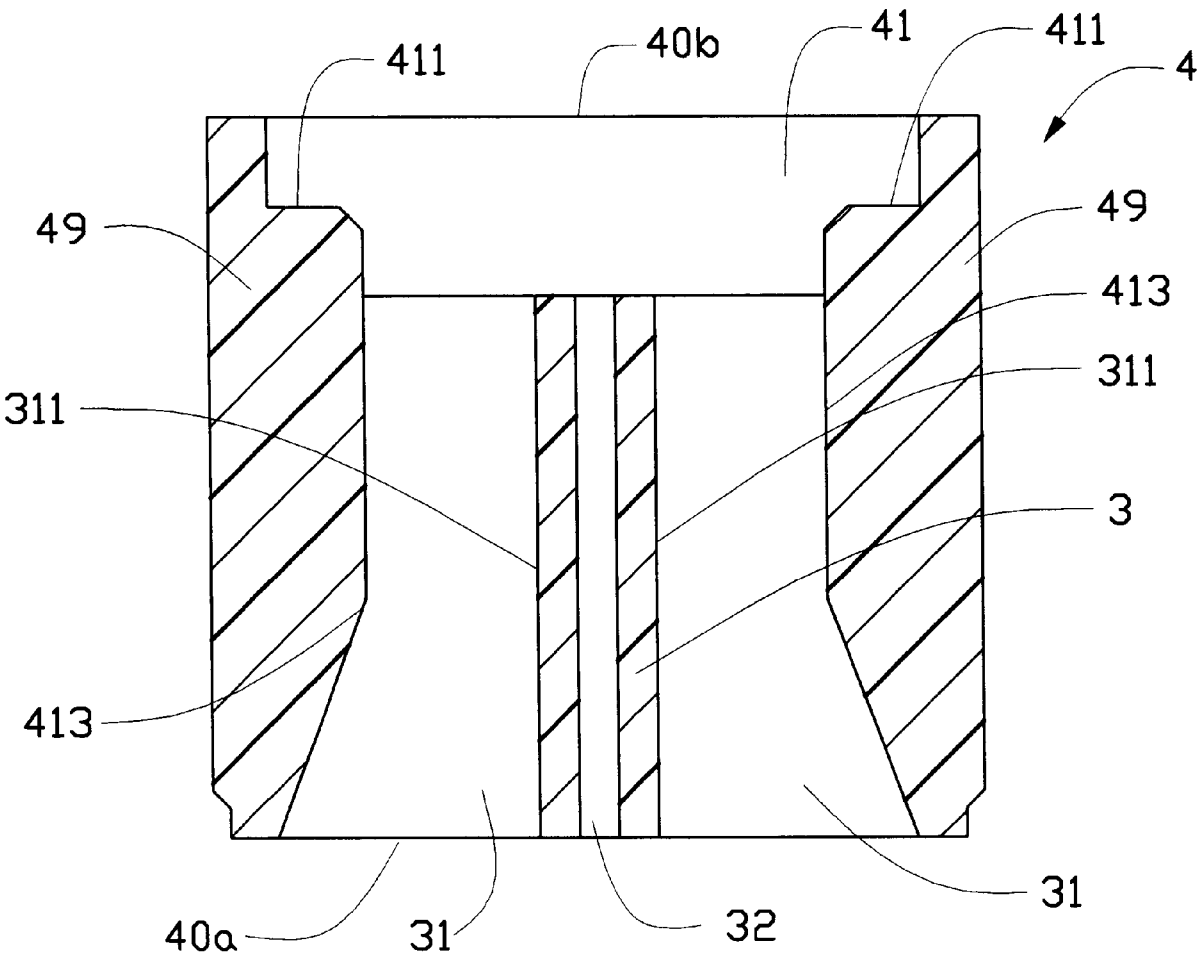
FIG. 3 is a cross-sectional view taken along line III—III of FIG. 2.
Figure 4:
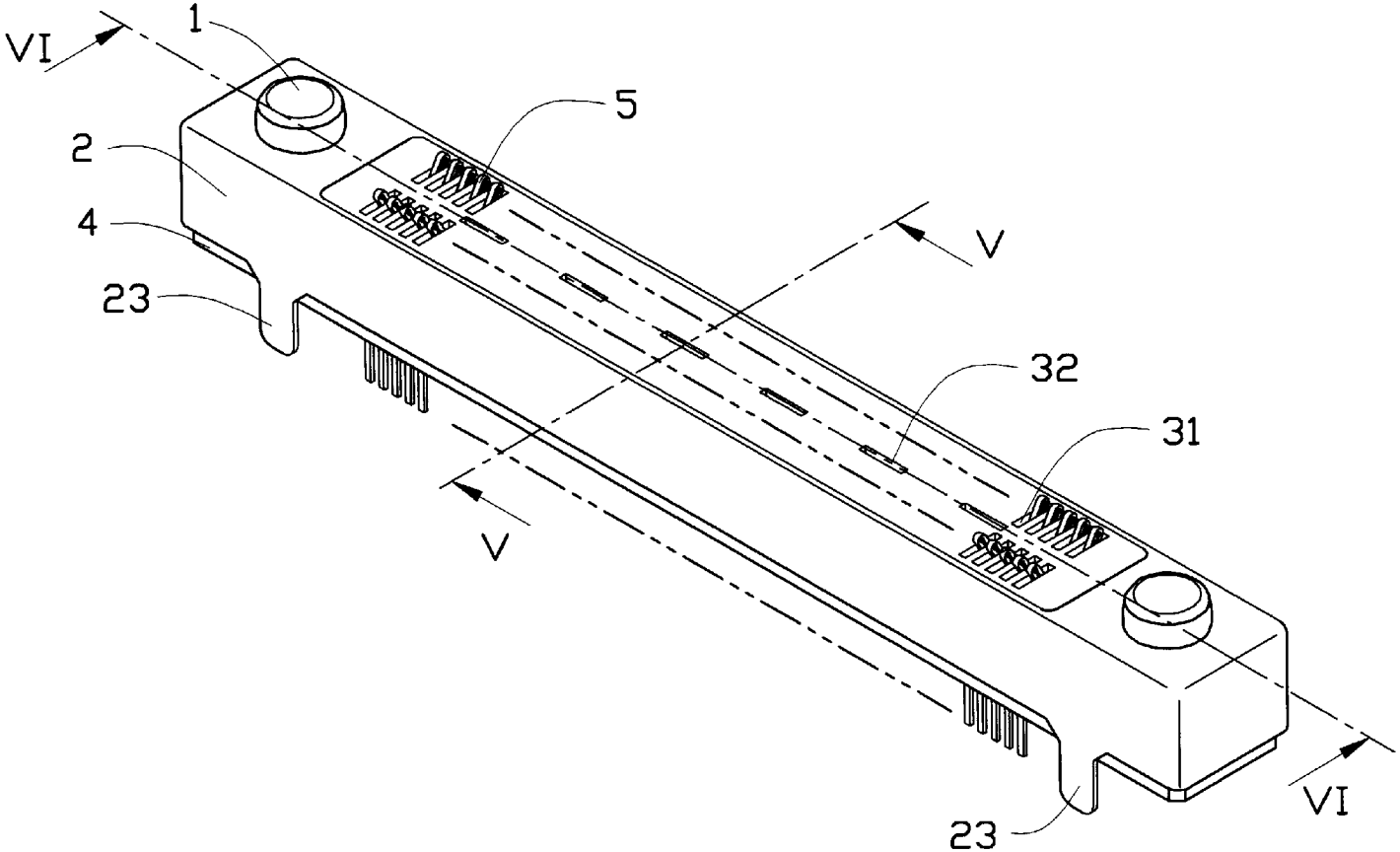
FIG. 4 is an assembled view of FIG. 1.

Also referring to FIGS. 3 and 4, the housing 4 defines a plurality of contact receiving channels 31 therein disposed in two rows in the lengthwise direction. The contact receiving channels 31 extend from the mating face 40*a* of the housing 4 and into the cavity 41. A partition wall 312 is formed between two adjacent contact receiving channels 31 of the same row. The two rows of the contact receiving channels 31 are spaced by an internal wall 3 of the housing 4 and bound by two side walls 49 of the housing 4. Each side wall 49 has an inside face 413.

Figure 6:
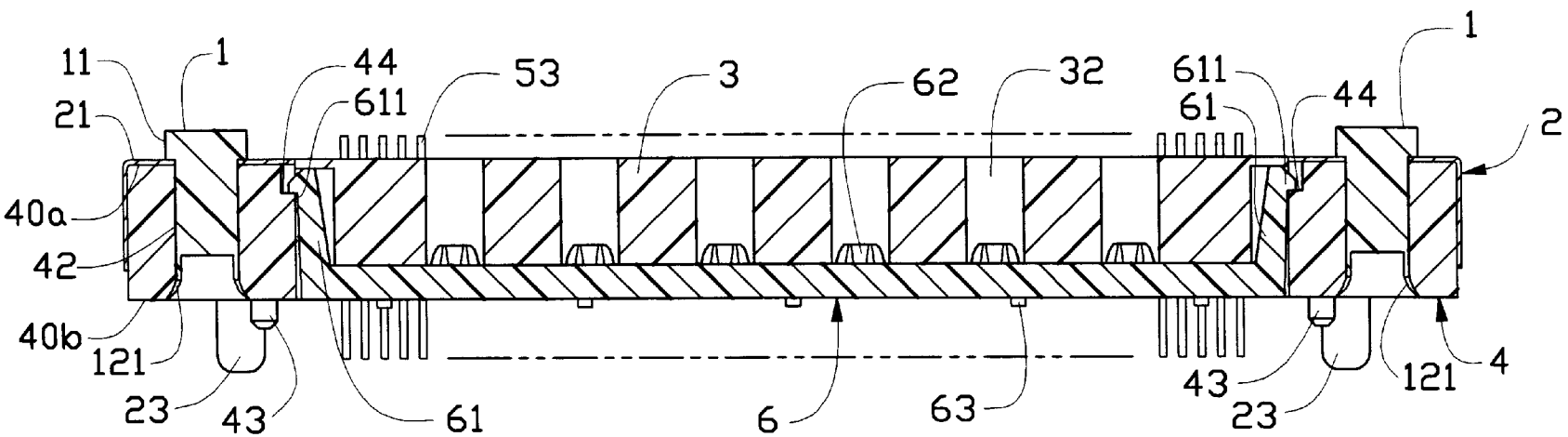
FIG. 6 is a cross-sectional view taken along line VI—VI of FIG. 4.

The cavity 41 forms a shoulder 411 on each side wall 49 of the housing 4. A number of bores 32 are defined in the internal wall 3 and within the cavity 41 for receiving positioning pins 62 of the insert 6 therein, preferably in an interferential manner for securing the insert 6 in the cavity 41. The insert 6 further comprises two resilient arms 61 formed at opposite ends thereof, each arm 61 having a barb 611 engageable with an internal shoulder 44 (FIG. 6) formed inside the housing 4 for securing the insert 6 in the housing 4. The insert 6 also has a plurality of positioning projections 63 for positioning on a circuit board (not shown).

Figure 5:
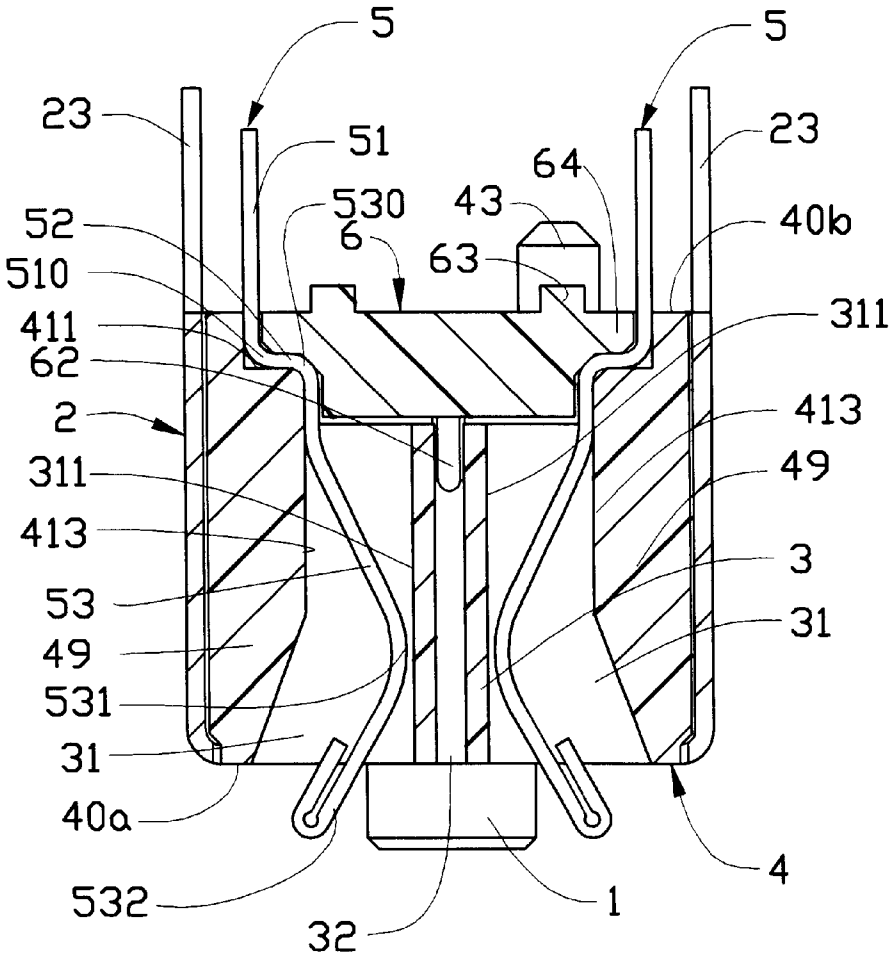
FIG. 5 is a cross-sectional view taken along line V—V of FIG. 4.

Each contact receiving channel 31 receives a plug contact element 5 therein. As shown in FIG. 5, each plug contact element 5 comprises a mating section 53 disposed in the corresponding contact receiving channel 31 and substantially extending along a first axis (not labeled) normal to the mating face 40*a* and a mounting section 51 extending beyond the mounting face 40*b* of the housing 4. A fixing section 52 is formed between the mating section 53 and the mounting section 51. The fixing section 52 forms a right-angled portion 530 at a junction with the mating section 53 and is supported on the shoulder 411 of the housing 4 with a portion of the mating section 53 supported by the inside face 413 of the side wall 49 of the housing 4. The insert 6 has a side flange 64 formed on each side thereof and extending above the shoulder 411 of the side wall 4 thereby overlapping and thus retaining the fixing section 52 in position.

In the embodiment illustrated, the fixing section 52 of each plug contact element 5 forms a right-angled portion 510 at a junction with the mounting section 51 which renders the mounting section 51 to be substantially parallel to the mating section 53. The right-angled portion 510 causes the mounting section 51 to extend in a direction substantially normal to the mounting face 40*b*.

The mating section 53 of each plug contact element 5 comprises a tip portion 532 extending beyond the mating face 40*a* and inclined with respect to the first axis which is normal to the mating face 40*a* and an arcuate portion 531 connecting the tip portion 532 to the fixing section 52 of the plug contact element 5. The arcuate portion 531 is convex with respect to the internal wall 3 of the housing 4 and an apex thereof is located proximate or abutting against a corresponding surface 311 of the internal wall 3 for providing resiliency that allows the tip portion 532 to be deflected toward the mating face 40*a*. When the tip portion 532 is deflected, the apex of the arcuate portion 531 is moved toward and abuts against the internal wall 3 for supporting the deflection of the tip portion 532.

A shield casing 2 has an open bottom fit over the housing 4 for surrounding the housing 4 (FIGS. 4 and 5). Grounding tabs 23 extend from the shield casing 2 for electrically grounding the shield casing 2. The shield casing 2 has a top wall 21 positioned on the mating face 40*a* of the housing 4. The top wall 21 of the shield casing 2 defines a central opening 24 for exposing the contact receiving channels 31.

The top wall 21 of the shield casing 2 further defines two pin holes 22. Corresponding to each pin hole 22 of the shield casing 2, a bore 42 is defined in the housing 4. A guide post 1 has a post body 11 and a reduced pin section 12 inserted through the pin hole 22 and fit into the bore 42 with the post body 11 supported on the top wall 21 of the shield casing 2. The reduced pin section 12 has a tubular end 121 (FIG. 6) which may be expanded to comply with a flaring end of the bore 42 thereby securing the guide post 1, the shield casing 2 and the housing 4 together.

The housing 4 may comprise positioning pins 43 extending from the mounting face 40*b* thereof for properly positioning the plug connector 10 on a device or circuit board (not shown) to which the plug connector 10 is to be mounted.

Figure 7:
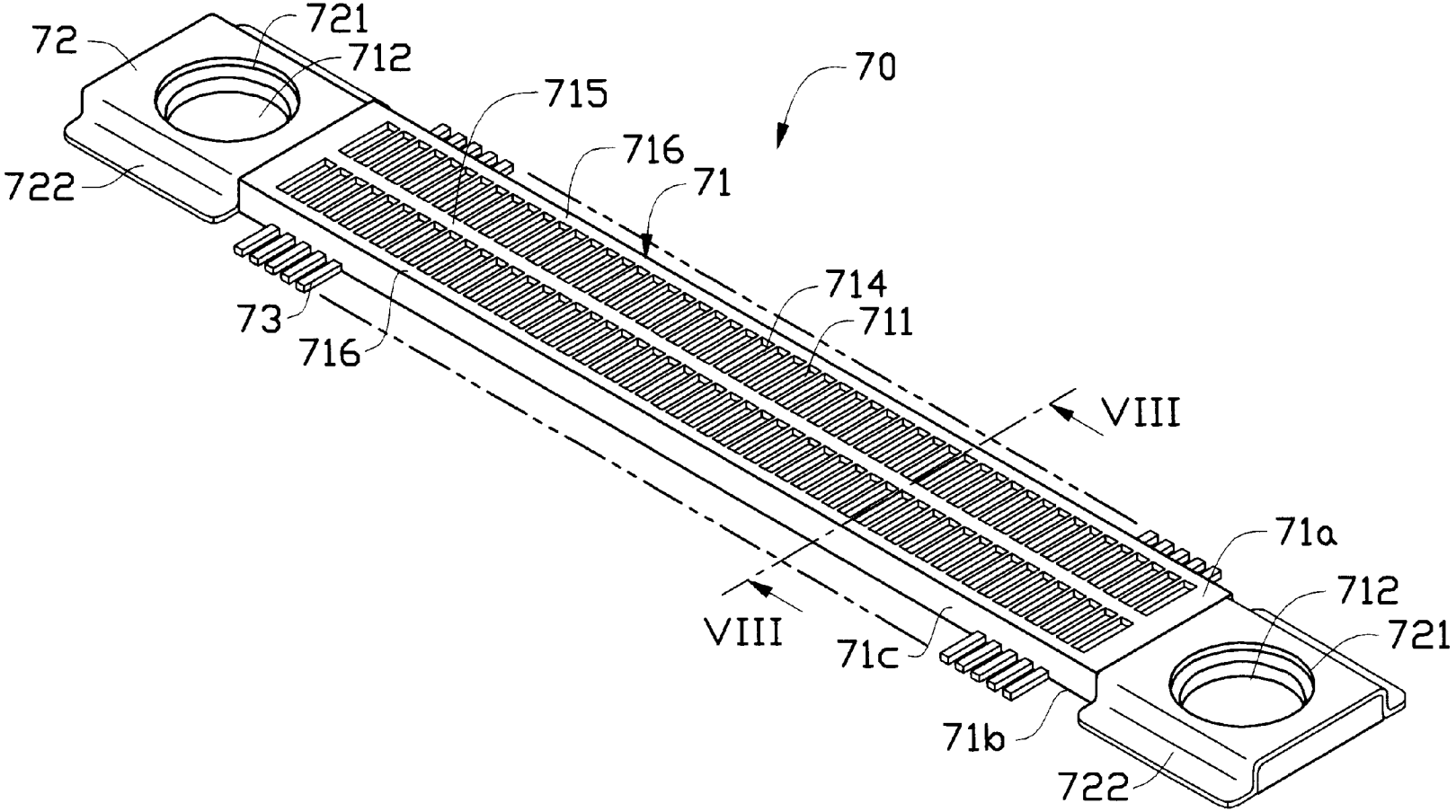
FIG. 7 is a perspective view of a socket connector of the electrical connection system of the present invention.

FIG. 7 shows the socket connector in accordance with the present invention, which is designated by reference numeral 70. The socket connector 70 comprises an elongate insulative housing 71 having a mating face 71*a* (also see FIG. 8) overlappingly engageable with the mating face 40*a* of the housing 4 of the plug connector 10 (FIG. 10D) and a mounting face 71*b* opposite the mating face 71*a*.

Figure 8:
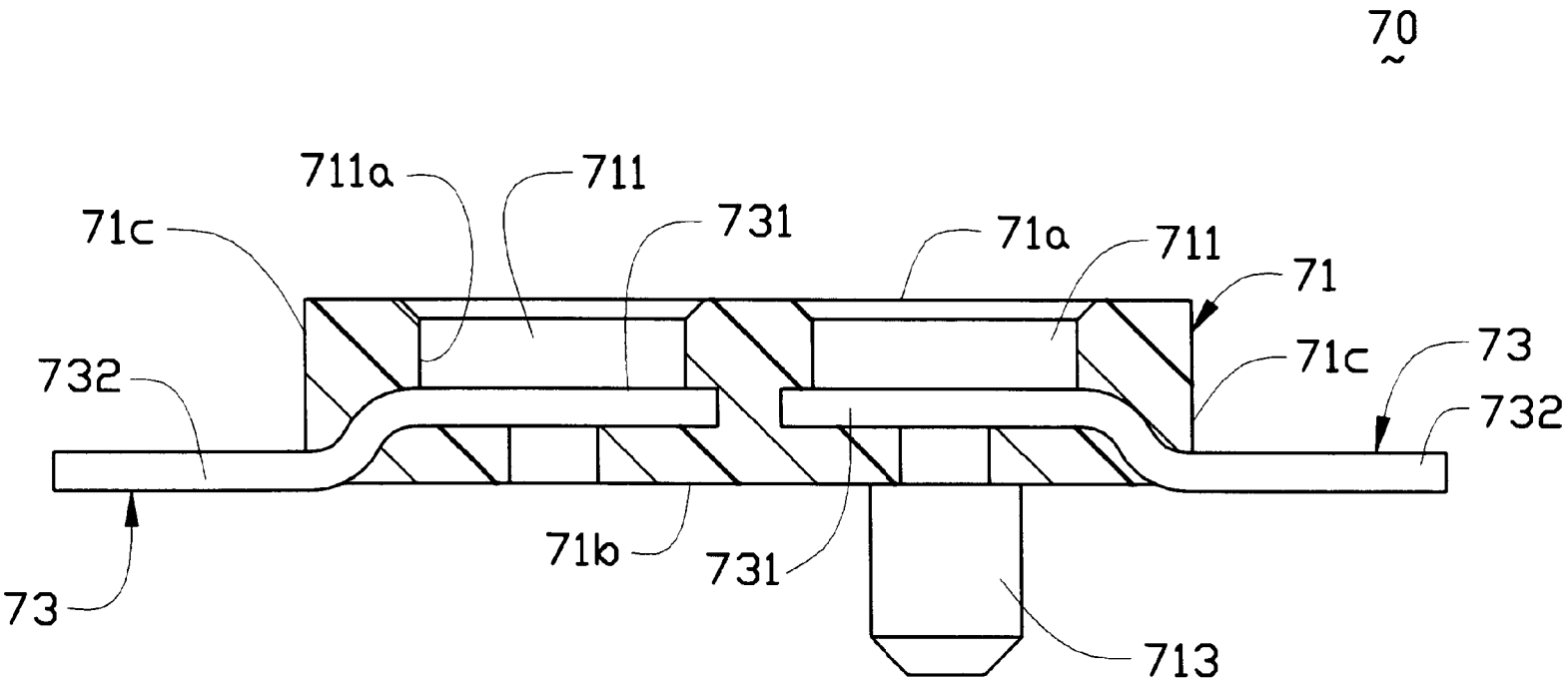
FIG. 8 is a cross-sectional view taken along line VIII—VIII of FIG. 7.

The housing 71 defines a plurality of passageways 711 extending from the mating face 71*a* thereof to a predetermined depth defining a bottom (not labeled). The passageways 711 are disposed in two rows along the lengthwise direction corresponding to the plug contact elements 5 for receiving the tip portions 532 therein. The passageways 711 of the same row are separated by partition walls 714, while the two rows are separated by an internal wall 715 and bound by two side walls 716 of the housing 71. The internal wall 715 and the side walls 716 form end faces 711*a* of the passages 711 (FIG. 8).

A socket contact element 73 is fixed in the housing 71 of the socket connector 70 and associated with each of the passageways 711. The socket contact element 73 has a mating section 731 supported on the 15 bottom of the passageway 711 and extending along a second axis which is substantially parallel to the mating face 71*a* (and normal to the depth of the passageway 711) and a mounting section 732 extending beyond a side wall 71c of the housing 71 and substantially coplanar with the mounting face 71*b* for surface-mounting to a device or a circuit board (not shown). If desired, the mounting section 732 may extend beyond the mounting face 71*b* rather than the side wall 71*c*.

The socket housing 71 further comprises positioning pins 713 formed on the mounting face 71*b* for properly positioning the socket connector 70 on a device or a circuit board (not shown).

Figure 10A:
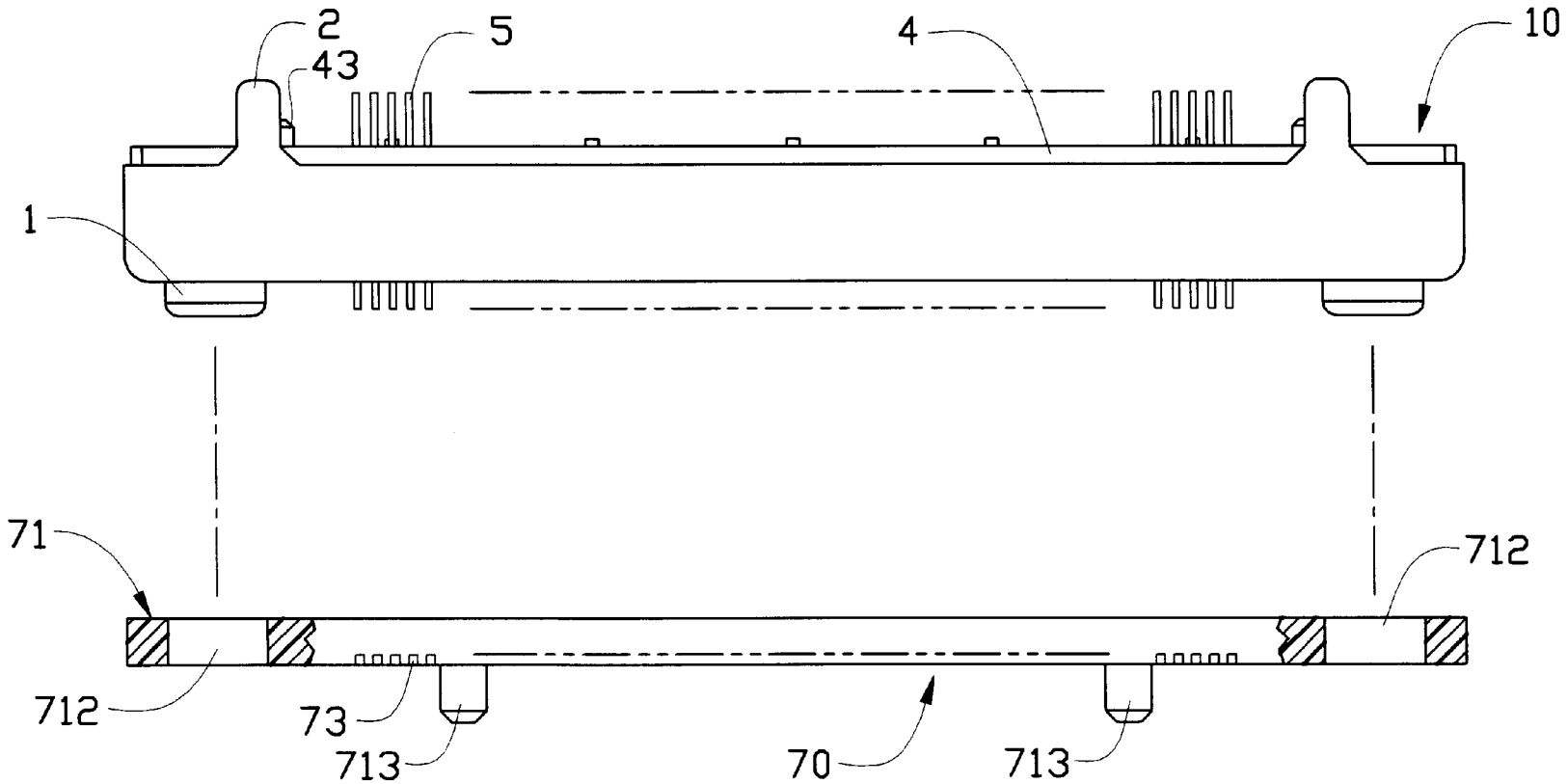
FIG. 10A is a schematic view showing the spatial relationship between the plug connector and the socket connector when mating the connectors together.

A post receiving hole 712 is defined in the socket housing 71 corresponding to and receiving the post body 11 of the guide post 1 fixed in the plug connector 10 for properly positioning the plug connector 10 with respect to the socket connector 70 as shown in FIG. 10A. Preferably, a plate member 72 made from a metal sheet is attached to the portion of the socket housing 71 in which each post receiving hole 712 is defined. The plate member 72 defines an opening 721 aligned with the post receiving hole 712 for the reception of the guide post 1. The plate member 72 may have sideways extensions 722 for soldering to the device or circuit board to which the socket connector 70 is mounted.

The plate members 72 are engageable with the top wall 21 of the shield casing 2 of the plug connector 10 and an electrical connection may be formed therebetween for grounding purposes.

As shown in FIG. 10A, when mating the plug connector 10 to the socket connector 70, the plug connector 10 is positioned with respect to the socket connector 70 with the mating faces 40*a*, 71*a* thereof substantially parallel to and facing each other and the guide posts 1 of the plug connector 10 in alignment with the post receiving holes 712 of the socket connector 70. The plug and socket connectors 10, 70 are moved toward each other to insert the tip portions 532 of the plug contact elements 5 into the corresponding passageways 711 of the socket connector 70 as shown in FIG. 10B. A further movement of the connectors 10, 70 toward each other brings the tip portions 532 of the plug contact elements 5 into engagement with the mating sections 731 of the socket contact elements 73 as shown in FIG. 10C. Initially, only a point contact engagement is formed between the tip portion 532 of the plug contact element 5 and the mating section 731 of the socket contact element 73.

Further moving the connectors 10, 70 toward each other leads to a deflection of the arcuate portions 531 of the plug contact elements 5 which positions the apexes of the arcuate portions 531 against the internal wall 3 of the plug housing 4 for supporting further deflection of the arcuate portions 531 caused by the movement of the connectors 10, 70 toward each other. The deflection of the arcuate portions 531 changes the inclination of the tip portions 532 with respect to the mating sections 731 of the socket contact elements 73 thereby changing the contact engagement from the point contact to a surface contact.

During the deflection of the arcuate portions 531, the tip portions 532 of the plug contact elements 5 slide on the corresponding mating sections 731 of the socket contact elements 73. The tip portions 532 may be dimensioned to engage with the end faces 711*a* of the passageways 711 after the sliding motion which may result in a firmer engagement between the tip portions 532 of the plug contact elements 5 and the mating sections 731 of the socket contact elements 73.

Figure 10D:
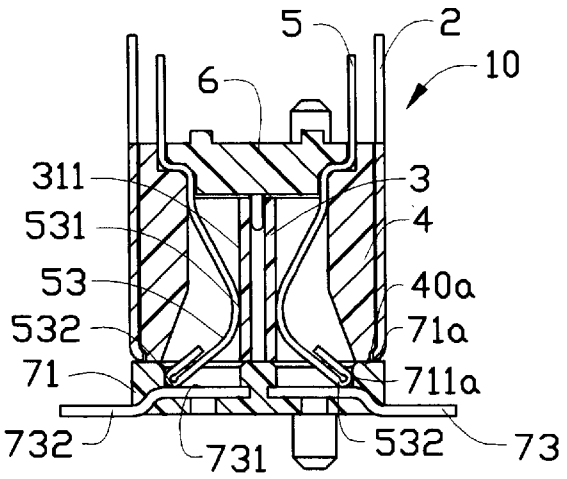
FIGS. 10B–10D are cross-sectional, sequential views showing different steps of mating the plug connector with the socket connector.
Figure 10C:
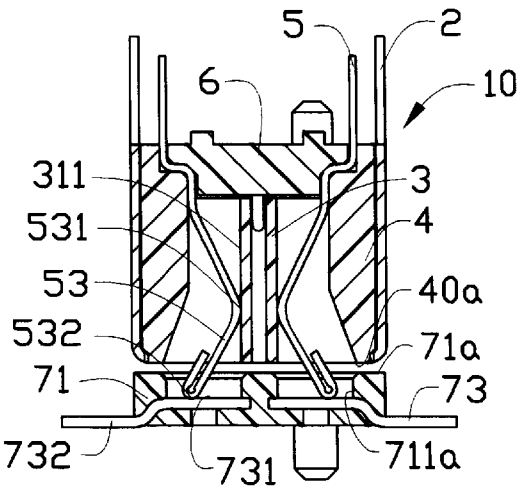
Figure 10B:
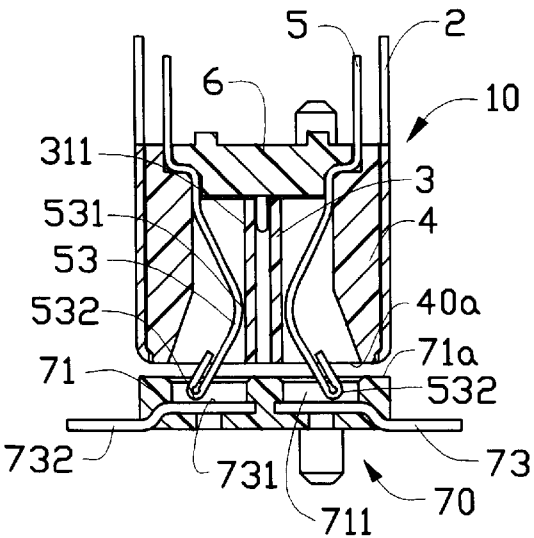

Eventually, the mating faces 40*a*, 71*a* of the connectors 10, 70 overlappingly engage with each other as shown in FIG. 10D and securely position the tip portions 532 of the plug contact elements 5 against the mating sections 731 of the socket contact elements 73.

In accordance with another aspect of the present invention, the plug connector 10 may engage with a circuit board 8 (FIG. 11A) directly. To accommodate the guide posts 1 of the plug connector 10, the circuit board 8 is provided with post receiving holes 83 on a substrate board 81 thereof. The circuit board 8 is also provided with conductive pads or traces 82 for electrically engaging with the plug contact elements 5 of the plug connector 10.

Figure 11A:
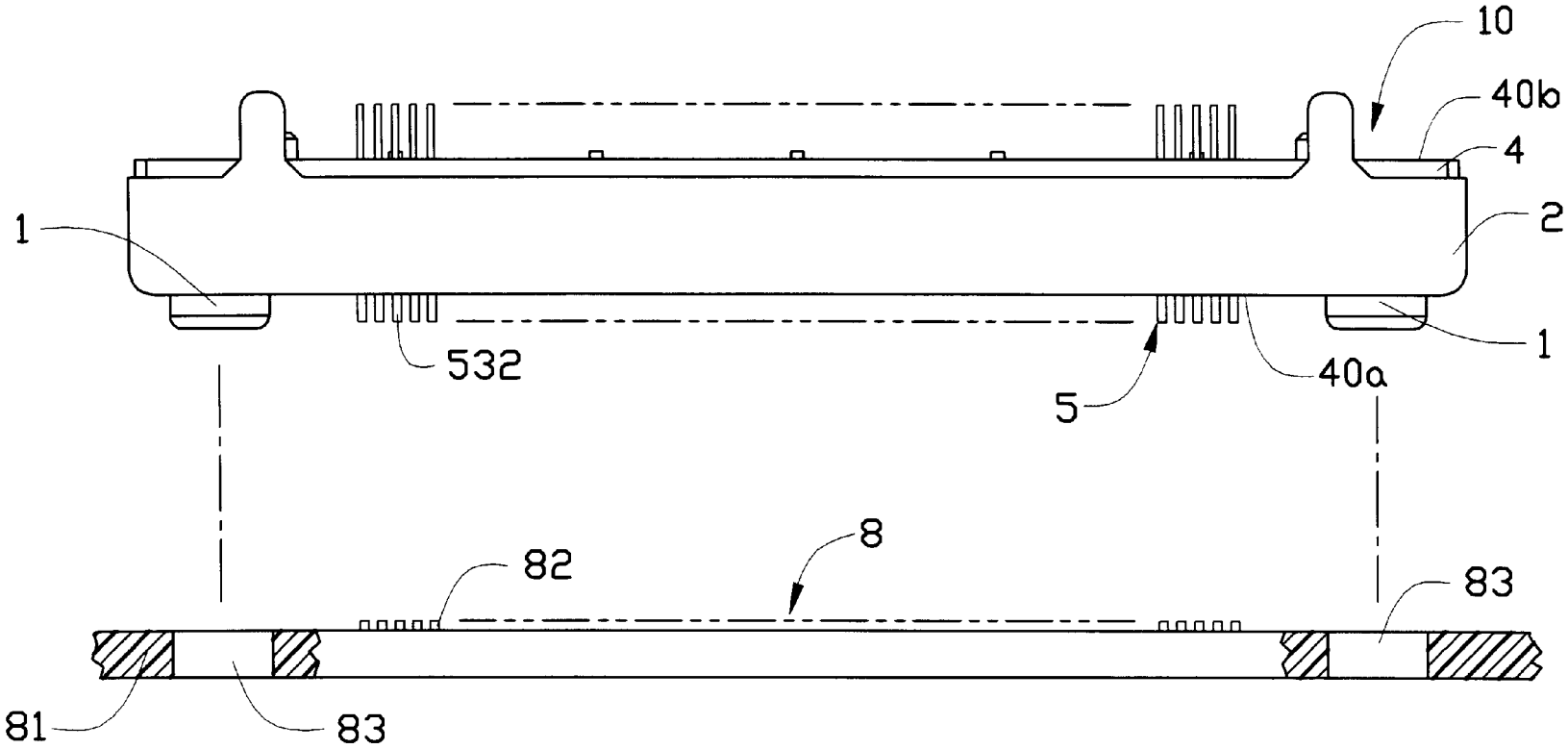
FIG. 11A is a schematic view showing the spatial relationship between the plug connector and a circuit board to be electrically engaged together.
Figure 11D:
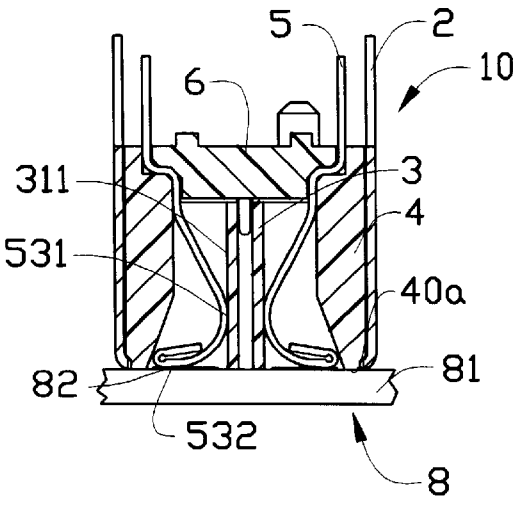
FIGS. 11B–11D are cross-sectional, sequential views showing the different steps when engaging the plug connector with the circuit board.

As shown in FIG. 11A, the plug connector 10 is positioned with respect to the circuit board 8 with the mating face 40*a* thereof facing the circuit board 8. The plug connector 10 is moved toward the circuit board 8 to insert the guide posts 1 into the post receiving holes 83 of the circuit board 8 and the tip portions 532 of the plug contact elements 5 engaging with the conductive pads 82 as shown in FIG. 11B. A point contact is formed between each plug contact element 5 and the corresponding conductive pad 82 of the circuit board 8.

Figure 11C:
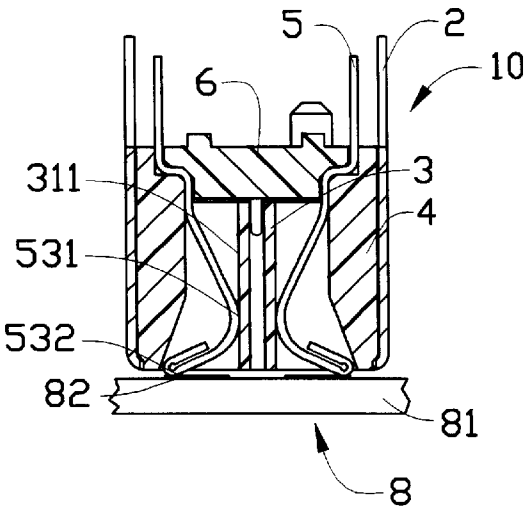
Figure 11B:
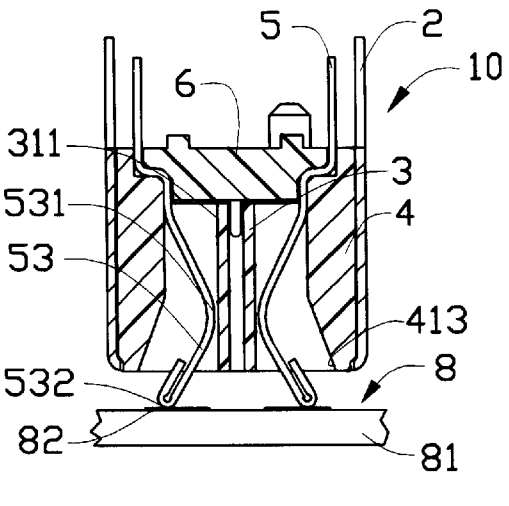

Further moving the plug connector 10 toward the circuit board 8 deflects the arcuate portions 531 of the contact elements 5 and the tip portions 532 slide on the conductive pads 82 as shown in FIG. 11C. Eventually, the mating face 40*a* of the plug connector 10 engages with the circuit board 8 and the arcuate portions 531 of the contact elements 5 are deflected to such an extent that the tip portions 532 are received in the contact receiving channels 31 of the housing 4 and the point contact is changed to a surface contact.

Figure 9B:
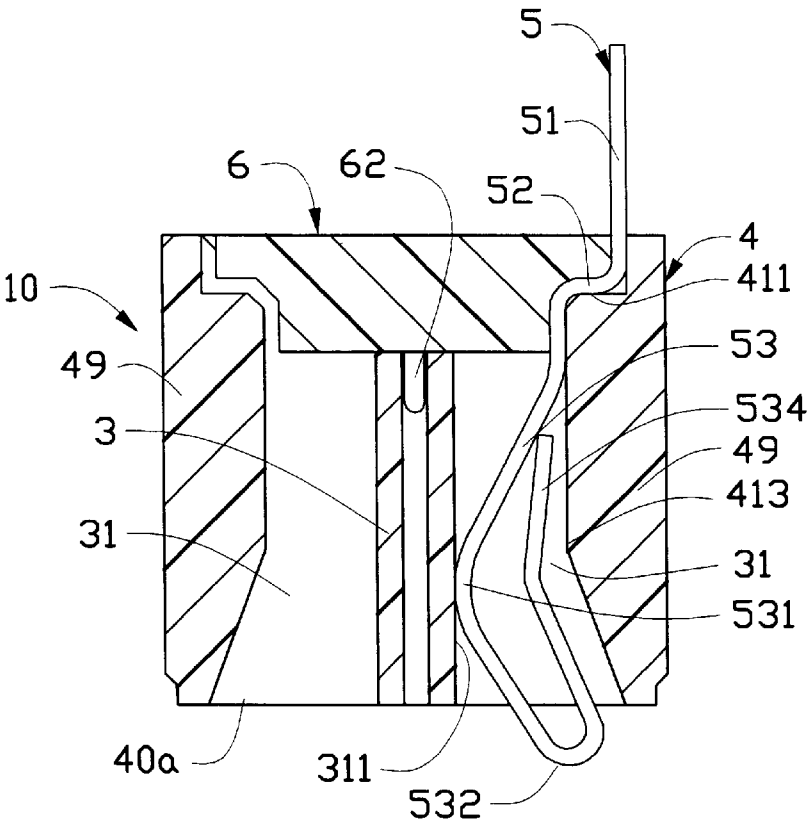
FIG. 9B is a cross-sectional view similar to FIG. 5, but showing a third embodiment of the plug connector of the present invention.
Figure 9A:
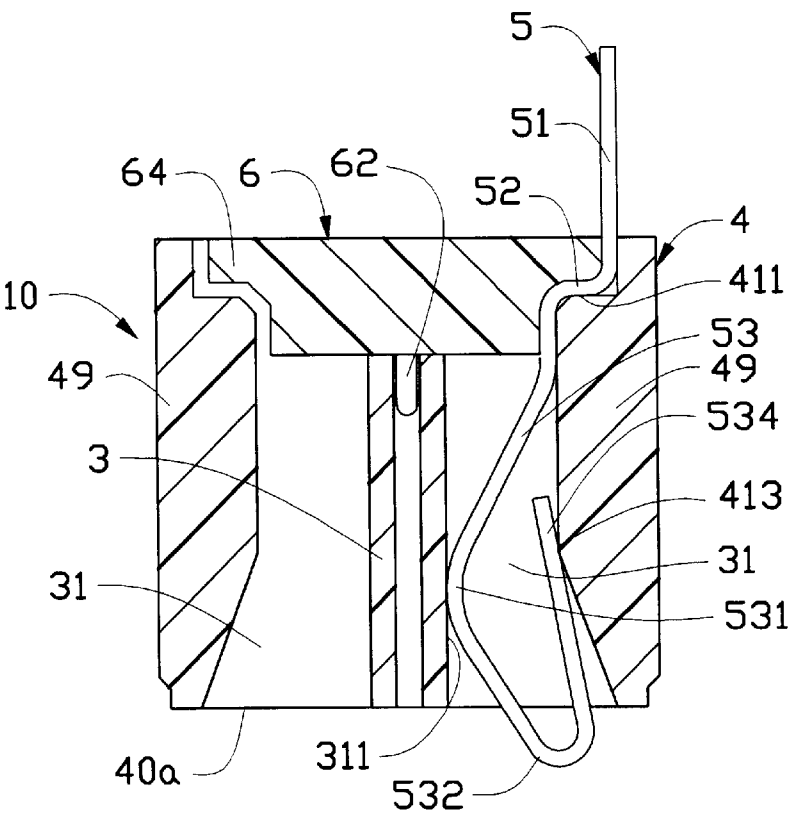
FIG. 9A is a cross-sectional view similar to FIG. 5, but showing a second embodiment of the plug connector of the present invention.

Although the present invention has been described with reference to preferred embodiments, it is apparent to those skilled in the art that a variety of modifications and changes may be made without departing from the scope of the present invention which is intended to be defined by the appended claims. For example, as shown in FIG. 9A, the mating section 53 of each plug contact element 5 can be provided with a backward bent extension 534 which engages with the inside face 413 of the side wall 49 of the housing 4 for more securely retaining the plug contact element 5 in position during the deflection of the arcuate section 531 thereof. In addition, as shown in FIG. 9B wherein a further modification of the plug contact element 5 is shown, the backward bent portion 534 is shaped in compliance with an inclined configuration of the inside face 413 of the side wall 49 of the housing 4 for more securely retaining the contact element 5. Obviously, these and other modifications should be deemed within the scope of the present invention and be protected by the patent issued thereto.

What is claimed is:

1. A method for electrically mating a plug connector having plug contact elements with a socket connector having socket contact elements to electrically engage the plug contact elements with the corresponding socket contact elements, the method comprising the following steps:

(a) arranging each plug contact element in the plug connector to have a mating section of the plug contact element extending along a first axis, the mating section of the plug contact element comprising a tip portion and a deflectable portion wherein the tip portion is supported by the connector;

(b) arranging each socket contact element in the socket connector to have a mating section of the socket contact element retained in a passageway defined in the socket connector and extending along a second axis which is substantially normal to the first axis, and a mounting section of the socket contact element to be extended outwardly and transversely from the socket connector;

(c) moving the plug and socket connectors toward each other to insert the tip portions of the plug contact elements into the passageways and forming a point contact engagement with the mating sections of the socket contact elements;

(d) further moving the plug and socket connectors toward each other to cause deflection of deflectable portions of the plug contact elements with the tip portions sliding on the mating sections of the socket contact elements; and (e) deflecting the deflectable portion of the plug contact elements by further moving the plug and socket connectors toward each other to change the point contact between the plug contact elements and the socket contact elements to a surface contact therebetween; wherein each passageway of the socket connector has an end wall positioned perpendicularly to the mating section of the corresponding socket contact element and located in the sliding direction of the tip portion of the corresponding plug contact element received therein, and wherein the method further comprises the following step:

(f) sliding the tip portions of the plug contact elements along the mating sections of the socket contact elements until the tip portions engage with and are stopped by the end walls of the passageways.

2. The method as claimed in claim 1, wherein the plug connector has guide posts extending therefrom and the socket connector defines post receiving holes therein corresponding to the guide posts, and wherein step (c) further comprises a sub-step of inserting the guide posts of the plug connector into the post receiving holes of the socket connector.

3. The method as claimed in claim 1, wherein the plug connector has a mating face beyond which the tip portions of the plug contact elements extend and the socket connector has a mating face in which the passageways are defined, and wherein the method further comprises the following step:

(g) moving the plug and socket connectors toward each other until the mating faces thereof overlappingly engage with each other.

4. The method as claimed in claim 1, wherein the deflectable portion of each plug contact element comprises an arcuate portion having an apex located proximate an internal face of the plug connector, and wherein step (d) comprises a sub-step of causing the apexes of the arcuate portions to move close to and abut against the internal face of the plug connector for supporting the deflection of the arcuate portions.

5. A system for interconnecting two electrical components, comprising:

a first electrical component including a first body with a plurality of first contact elements thereabout, said first contact elements including a mating section with an deflectable actuate portion generally extending along a first axis, and a tip portion thereof, an apex of said actuate portion located proximate a corresponding surface of an internal wall of said first body; and a second electrical component including a second body with a plurality of passageways therein, a plurality of second contact elements respectively received in the corresponding passageways, said second contact elements including mating sections extending in a second axis normal to said first axis, a mounting section of each of said second contact elements to be extended outwardly and transversely from the second electrical component, each of said passageways defining an end wall positioned perpendicularly to the mating section of the corresponding second contact element and located in a sliding direction of the tip portion of the corresponding first contact elements; wherein the first body and the first contact elements of the first electrical component, and the second body and the second contact elements of the second electrical component are properly dimensioned so that when the first electrical component and the second electrical component are mated with each other, the tip portions of the first contact elements initially touch the corresponding second contact elements, respectively, and then continuously move on the second contact elements along the second axis until the tip portions of the first contact elements engage with and are stopped by the end walls of said corresponding passageways; wherein both the actuate portion and the associate tip portion of the mating section are deflectably deformed during mating of the first electrical component and the second electrical component.

* * * * *